US005896911A

United States Patent [19]

Gegel

[11] Patent Number: 5,896,911

[45] Date of Patent: Apr. 27, 1999

[54] PROCESS FOR MAKING A SELECTIVELY REINFORCED GROUND ENGAGING TOOL COMPONENT

[75] Inventor: Gerald A. Gegel, Morton, Ill.

[73] Assignee: Caterpillar Inc., Peoria, Ill.

[21] Appl. No.: 08/626,231

[22] Filed: Mar. 29, 1996

[51] Int. Cl.[6] ..... B22D 19/02; B22D 19/14

[52] U.S. Cl. ..... 164/4.1; 164/97; 164/98; 164/108

[58] Field of Search ..... 164/4.1, 97, 98, 164/108

[56] References Cited

U.S. PATENT DOCUMENTS

| | | | |
|---|---|---|---|
| 4,146,080 | 3/1979 | Baum | 164/97 |
| 5,284,200 | 2/1994 | Gegel | 164/98 |
| 5,337,801 | 8/1994 | Materkowski | 164/98 |
| 5,346,148 | 9/1994 | Hand et al. | 164/108 X |

FOREIGN PATENT DOCUMENTS

| | | | |
|---|---|---|---|
| 272429 | 10/1989 | Germany | 164/97 |
| 59-39461 | 3/1984 | Japan | 164/97 |
| 62-9763 | 1/1987 | Japan | 164/98 |
| 64-55370 | 3/1989 | Japan | 164/98 |
| 3-216263 | 9/1991 | Japan | 164/97 |

*Primary Examiner*—J. Reed Batten, Jr.
*Attorney, Agent, or Firm*—Calvin E. Glastetter

[57] ABSTRACT

A metal ground engaging tool (GET) component is selected. One or more critical wear surfaces on the GET component are identified. The GET component is selectively reinforced by depositing one or more metal matrix composite components at the one or more identified critical wear surfaces on the GET component. The metal matrix composite components consist of a reinforcement preform and a metal. The preform is formed from a material selected from one of ceramic, cermet, or mixtures thereof. The metal is selected from one of iron, alloy steel, or mixtures thereof. The reinforcement preform is present in the metal matrix composite in the range of about 30% to about 60% by volume.

21 Claims, 2 Drawing Sheets

PROCESS FOR MAKING A SELECTIVELY REINFORCED GROUND ENGAGING TOOL COMPONENT

TECHNICAL FIELD

The present invention relates generally to ground engaging tools for earthworking machines, and more particularly to a process for selective reinforcement of ground engaging tools with highly wear resistant metal matrix composite wear components.

BACKGROUND ART

The earthworking machinery industry has for years experienced the challenge of designing ground engaging tools (GET's) that not only have a combination of abrasion resistance, long wear life and impact resistance, but also the ability to retain their original shape and dimensions even after repeated use. The shape of a GET component, such as a bucket tip, is defined by several surfaces that are geometrically related to each other. This designed geometrical relationship of a GET component affects the earthmoving efficiency, such as the ability to penetrate soil and/or rocks, of the GET component. As a GET component penetrates soil and/or rocks, it begins to wear at locations where the normal forces acting upon the GET component by the soil and the resultant frictional stresses, are the highest. With the passage of time, the surfaces of the GET component become abraded in a non-uniform manner and the geometrical relationship of the various surfaces with respect to one another is altered. This alteration of the GET component's shape detrimentally affects its performance.

In the past, increased wear resistance has been achieved by increasing the hardness of the wear component of the GET component while high impact strength has been attained by increasing the fracture toughness of the wear component. It is known in the industry that the useful life of a GET component is related not only to the wear and impact resistance properties of its cutting edge or cutting bit, but is also related to the retention of dimensional relationship between the various facets of the GET component.

In the past, researchers at Caterpillar Inc., the assignee of the present invention, have developed composite materials having a combination of impact and wear resisting surfaces. Other methods developed at Caterpillar Inc. include techniques where abrasion resistant materials are welded onto a surface of, or into cavities in, the metal base comprising the GET component. Although the foregoing techniques have been very successful, there is a desire to continuously improve the ability of the GET component to retain its dimensional characteristics and thus retain its earthworking efficiency.

It has thus been desirable to have GET components having wear resistant materials that impart a combination of (i) wear and impact resistance properties, and (ii) properties that enable the GET component to retain its dimensional characteristics even at those locations on the tool which are exposed to most severe impact and abrasion forces.

The present invention is directed to overcome one or more problems of heretofore utilized GET components for the earthworking machinery industry.

DISCLOSURE OF THE INVENTION

In one aspect of the present invention, a process for selectively reinforcing a GET component for an earthworking machine with a wear and impact resistant metal matrix composite component is disclosed. The process comprises the following steps. A metal GET component is selected. One or more critical wear surfaces on the GET component are identified. The critical wear surfaces are the ones subjected to at least 25% greater wear forces as compared to the remaining surface on the GET component. The GET component is selectively reinforced by depositing one or more metal matrix composite components at the one or more identified critical wear surfaces on the GET component. The one or more metal matrix composite components consist of a reinforcement preform and a metal. The preform is formed from a material selected from one of ceramic, cermet, or mixtures thereof. The metal is selected from one of iron, alloy steel, or mixtures thereof. The reinforcement preform is present in the metal matrix composite in the range of about 30% to about 60% by volume.

In another aspect of the present invention, another process for selectively reinforcing a GET component for an earthworking machine with a wear and impact resistant metal matrix composite component is disclosed. The process comprises the following steps. A steel GET component is selected. One or more critical wear surfaces on the GET component are identified. The critical wear surfaces are the ones subjected to at least 25% greater wear forces as compared to the remaining surface on the GET component. The GET component is selectively reinforced by depositing one or more metal matrix composite components at the one or more identified critical wear surfaces on the GET component. The one or more metal matrix composite components consist of a reinforcement preform and an infiltration metal. The reinforcement preform has in the range of about 40% to about 60% interconnecting porosity. The preform is formed from a ceramic material selected from one of titanium carbide, aluminum oxide, titanium diboride and tungsten carbide. The infiltration metal is selected from one of iron, alloy steel, or mixtures thereof. The infiltration metal has a melting temperature equal to or greater than the melting temperature of the steel GET component. The porosity of the preform is infiltrated by the infiltration metal. The infiltration metal is fusion bonded to the steel GET component.

In yet another aspect of the present invention, another process for selectively reinforcing a GET component for an earthworking machine with a wear and impact resistant metal matrix composite component is disclosed. The process comprises the following steps. A metal GET component is selected. One or more critical wear surfaces on the GET component are identified. The critical wear surfaces are the ones subjected to at least 25% greater wear forces as compared to the remaining surface on the GET component. The GET component is selectively reinforced by depositing one or more metal matrix composite components at the one or more identified critical wear surfaces on the GET component by pressure infiltration casting process. In this process, the metal matrix composite component is fusion bonded to the metal GET component.

BEST MODE FOR CARRYING OUT THE INVENTION

Figure 1:
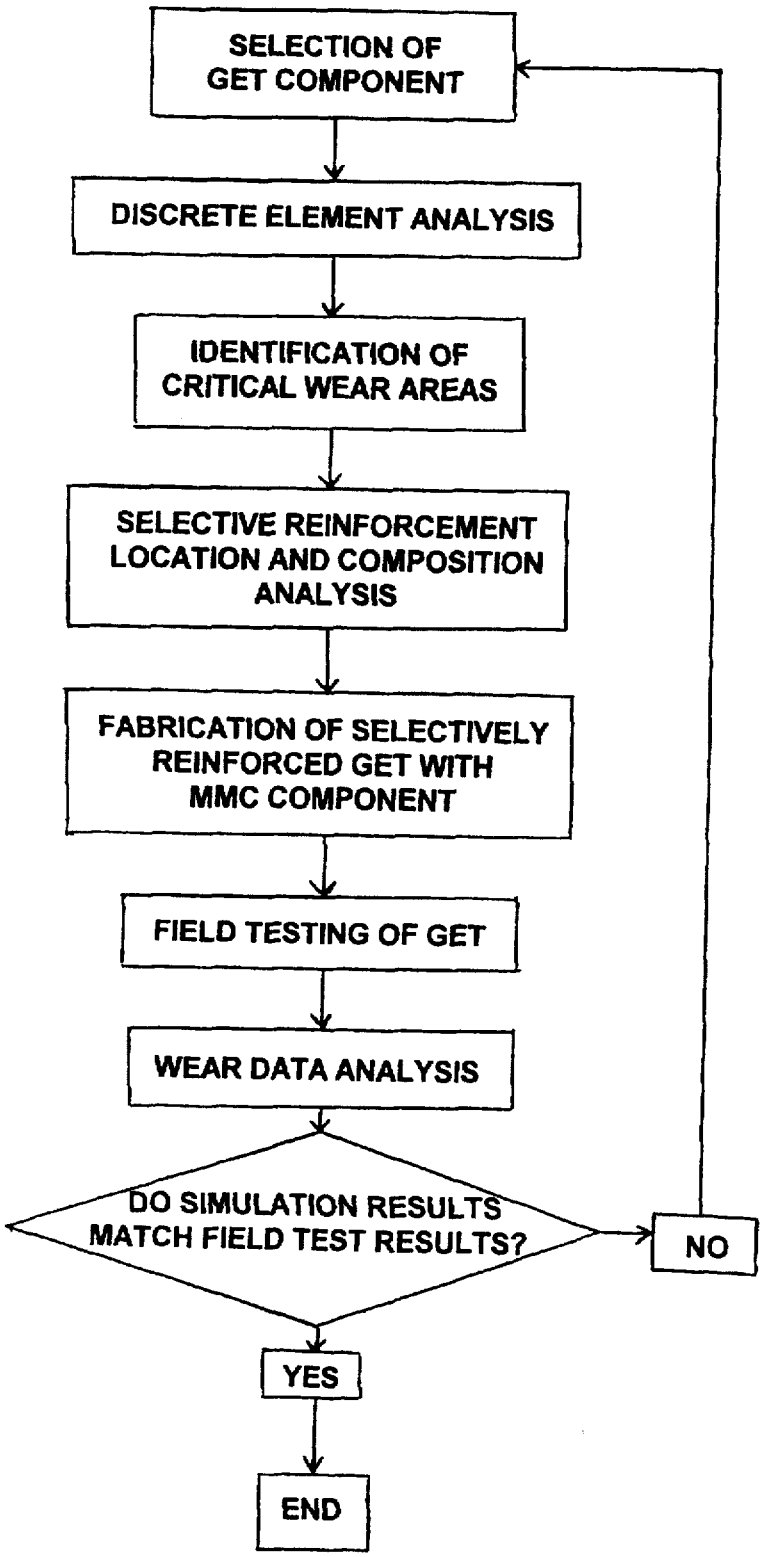
FIG. 1 is a schematic representation of the preferred embodiment of the process of the present invention.

As used in this description and in the claims, the term "selectively reinforced" means a GET component which has been reinforced by depositing wear resistant metal matrix composite components only in those identified locations on the GET component where increased wear resistance is required. The term "selectively reinforced" further means a reinforcement that is done by selecting the compositional makeup of the metal matrix composite, such as the volume % of the ceramic or cermet reinforcement in the matrix, to have a tailored metal matrix composite having a pre-determined amount of wear resistance properties. Selective reinforcement still further means placing the pre-determined amount of reinforcement in pre-determined locations on the GET component, thereby enabling the GET component to maintain its shape and its dimensional relationship during use.

As used in this description and in the claims, the term "critical wear surface" means those wear surfaces where the amount of wear forces experienced by the GET component are at least 25% greater than the wear forces experienced by the remaining surface of the GET component. Hence, critical wear surfaces, as defined, will wear more rapidly than the non-critical wear surfaces, unless these critical wear surfaces are reinforced. When these critical wear surfaces are selectively reinforced, the GET component will still experience some wear. However, the GET component will wear is an controlled fashion and the geometrical relationship of the various surfaces with respect to one another will be maintained.

As used in this description and in the claims, the term "depositing" includes depositing by pressure infiltration casting, plasma spray deposition, and other powder deposition techniques, which are well known to those skilled in the art.

As used herein, the term "identifying" means identifying the critical wear surfaces by various methods, such as discrete element analysis (DEA), finite element analysis (FEA), the study and analysis of actual laboratory wear test data on sample GET components, and the analysis of wear data obtained from actual field tests on GET components. Such analytical methods are well known to those skilled in the art.

As used in this description and in the claims, the term "reinforcement preform" refers to a porous body which can include fibers, whiskers, particulates and a porous pack which acts as a reinforcement phase which can be subsequently infiltrated by a metal to form a infiltrated preform.

As used herein, the term "infiltration" refers to the injection under pressure of a molten liquid. The molten infiltrate charge which can be a molten metal, a metal alloy or an intermetallic compound infiltrates into the preform under pressure.

The term "bonded" as used herein means any method of attachment between two bodies. The attachment may be physical, and/or chemical and/or mechanical. A physical attachment requires that at least one of the two bodies, usually in a liquid state, infiltrate at least a portion of the microstructure of the other body. This phenomenon is commonly known as "wetting". A chemical attachment requires that at least one of the two bodies chemically react with the other body to form at least one chemical bond between the two bodies. A mechanical attachment between two bodies includes a macroscopic infiltration of at least one of the two bodies into the interior of the other body. One example of mechanical attachment would be the infiltration of at least one of the two bodies into a groove or a slot on the surface of the other body. Such mechanical attachment does not include microscopic infiltration or wetting.

The term "fusion-bonding", as used herein, means a chemical attachment between the two bodies. This attachment occurs when the two bodies chemically react with each other and the two bodies are in a semi-molten state, especially at the interface, such that there is a weld formation at the interface where one body meets the other. The term "fusion bonding" as used herein does not mean physical and/or mechanical attachment but is rather a form of chemical bonding.

The term "metal matrix composite", as used herein, means a porous reinforcement preform used to form a metal matrix composite body wherein the porous reinforcement preform is infiltrated by an infiltration metal. The metal matrix composite has two or more physically and/or chemically distinct, suitably arranged or distributed components, and exhibits improved property characteristics that are not exhibited by any of the components in isolation. For example, a metallic component is reinforced by a ceramic or cermet component to form a metal matrix composite.

The term "interconnecting porosity", as used herein, means that the preform has a porous structure and the pores do not exist in isolation but rather, they are connected to one another to form interconnecting porous channels. These channels facilitate the infiltration of the infiltration metal into the preform.

The term "cermet" as used herein, describes a type of material that includes a ceramic component and a metal component. Examples of cermets include metal and ceramic carbides, such as for example, tungsten carbide, titanium carbide and cobalt.

In the preferred embodiment of the present invention, the GET component metal is one of cast iron or alloy steel. Preferably, the metal is an alloy steel. The alloy steel, in one embodiment, has a composition by weight percent comprising 0.22 to 0.29 carbon, 1.2 to 1.5 manganese no greater than 0.04 phosphorous and no greater 0.05 sulfur and balance iron. The alloy steel, in another embodiment, has a composition by weight percent comprising 0.36 to 0.44 carbon, 0.7 to 1.00 manganese, 0.15 to 0.3 silicon, 0.8 to 1.15 chromium, 0.15 to 0.25 molybdenum, no greater than 0.035 phosphorous, no greater than 0.04 sulfur and balance iron.

In the preferred embodiment of the present invention, the critical wear surfaces are the ones that are subjected to at least about 25% greater wear forces than the remaining surface on the GET component. Depositing a metal matrix composite on a wear surface experiencing less than about 25% greater wear forces is undesirable because it represent a waste of time, labor and resources because it is not essential to reinforce those surfaces. Only the surfaces that experience at least 25% greater wear forces will wear more rapidly than the remaining surface and will thus alter the dimensional relationship of the GET component.

As used herein, the term, "dimensional relationship" means the geometrical functionality of the a GET component. For example, if the GET component has the shape of a trapezoid, with parallel sides 1 and 2 being 10 mm and 20 mm in length respectively, and non-parallel sides 3 and 4 each being 50 mm in length, then say, the angle formed by sides 1 and 3, or by sides 1 and 4, is one dimensional relationship. An incremental change of more than about 25% in the above angle would represent a need for selective reinforcement. Likewise, in the above example, the ratio of the length of side 1 to each of sides 3 and 4 respectively, also represents a dimensional relationship.

In the preferred embodiment of the present invention, the reinforcement preform is present in the metal matrix composite component in the range of about 30% by volume to about 60% by volume. An amount less than 30% is undesirable because it will result in less than adequate reinforcement and wear resistance. An amount greater than about 60% is undesirable because it will detrimentally affect impact resistance. A value between 30% and 60% represents a balance between impact and wear resistance properties in a GET application.

In the preferred embodiment of the present invention, the metal matrix composite is bonded to the metal GET component by at least a chemical bond. Desirably, the metal matrix composite is bonded to the metal GET component by a combination of a chemical bond and one of physical bond, mechanical bonds, or a combination thereof. A physical bond is attained by partial encapsulation of the metal matrix composite by the metal tool by a pressure infiltration process as described hereunder.

In the preferred embodiment of the present invention, the preform has a configuration of one of a porous pack, particulates, tubules platelets, pellets, spheres, fibers, a woven mat, whiskers and mixtures thereof. Preferably, the preform has a configuration of particulates.

In the preferred embodiment of the present invention, the preform is formed from aluminum oxide particulates having a particle size in the range of 20 to 30 mesh. A particle size larger than 20 mesh size is undesirable because the packing density would be too low and the desired total porosity of the wear resistant preform will not be attained within the range of about 40% to about 60%. A particle size smaller than 30 mesh is undesirable because the packing density would be too high and the desired total porosity of the wear resistant preform will be less than about 40%. This will detrimentally reduce wear resistance of the resultant metal matrix composite.

In the preferred embodiment of the present invention, the ceramic material is at least one ceramic material desirably selected from the group consisting of titanium carbide, aluminum oxide, titanium diboride and tungsten carbide. Preferably, the ceramic material is aluminum oxide. Alternatively, the preform may also be made from ceramic materials selected from yttrium oxide, boron nitride, zirconium carbide, hafnium carbide, zirconium nitride, hafnium nitride, and diamond particulates.

In the preferred embodiment of the present invention, the cermet material is at least one cermet material desirably formed from (a) ceramic materials selected from the group consisting of titanium carbide, chromium carbide, titanium diboride and tungsten carbide, and (b) metallic materials selected from the group consisting of molybdenum, cobalt, tungsten, chromium, niobium and tantalum, or mixtures thereof. Preferably, the cermet is tungsten carbide and cobalt.

In the preferred embodiment of the present invention, the infiltration metal is desirably at least one of iron, alloy steel or mixtures thereof, and preferably, one of iron or alloy steel or mixtures thereof. In the preferred embodiment, the infiltration metal is an alloy steel, having a composition by weight percent comprising 0.36 to 0.44 carbon, 0.7 to 1.00 manganese, 0.15 to 0.3 silicon, 0.8 to 1.15 chromium, 0.15 to 0.25 molybdenum, no greater than 0.035 phosphorous, no greater than 0.04 sulfur and balance iron. The above composition is characteristic of an AISI 4140 steel. In yet another preferred embodiment, the infiltration metal is an alloy steel, having a composition by weight percent comprising 0.25 to 0.32 carbon, 0.50 to 0.90 manganese, 1.40 to 1.80 silicon, 1.60 to 2.00 chromium, no greater than 0.50 nickel, 0.30 to 0.40 molybdenum, no greater than 0.035 phosphorous, no greater than 0.04 sulphur, no greater than 0.15 copper, no greater than 0.03 aluminum, no greater than 0.02 vanadium, 0.025 to 0.04 zirconium, and balance iron.

Desirably, the infiltration metal has a melting temperature at least equal to or greater than the melting temperature of the GET component metal, and preferably, a melting temperature at least equal to or greater than that of the tool metal. The infiltrating metal melting temperature being equal to or greater than that of the tool metal causes the weld formation at the interface which is critical to obtaining a high bond strength. However, it should be noted that one skilled in the art may employ dissimilar metals for the infiltration and tool metals, as long as the fusion bond integrity is not detrimentally affected.

In the preferred embodiment, the infiltration metal is fusion bonded to the tool metal by the formation of a weld between the two metals at the interface, called the fusion interface. A fusion bond is the preferred method of attachment in order for the resultant metal matrix composite to withstand the rigorous wear and impact duty application which a GET component is subjected to.

In the preferred embodiment of the present invention, the preform, prior to being infiltrated by the infiltration metal, desirably has a total porosity in the range of about 40% to about 60% out of which, the interconnecting porosity is desirably at least 90% of total porosity, and preferably, at least 98% of the total porosity. A total porosity less than 40% is undesirable because there will not be enough infiltrant metal phase to obtain a high impact resistance. A total porosity greater than 60% is undesirable because there will not be enough reinforcement preform material to obtain a high wear resistance. A porosity in the range of about 40% and about 60% represents a compromise between the desired wear resistance and impact resistance of the metal matrix composite. An interconnecting porosity less than 90% of total porosity is undesirable because it will detrimentally result in insufficient infiltration of the preform by the infiltration metal, thus reducing wear and impact resistance.

In the preferred embodiment of the present invention, the preform, after being infiltrated by the infiltration metal, has a final porosity desirably no greater than 2% and preferably, no greater than 0.5%. A final porosity greater than 2% is undesirable because it will reduce the strength and impact resistance of the metal matrix composite component.

A selectively reinforced GET component for a dozer bucket edge is made by the process of the present invention in the following manner, as shown in Example A, according to the preferred embodiment of the present invention.

EXAMPLE A

The GET component metal selected is an AISI 1527 steel having the following composition by weight:

| | |
|---|---|
| carbon | 0.22% to 0.29% |
| manganese | 1.20% to 1.50% |
| phosphorous | 0.04% max. |
| sulphur | 0.05% max. |
| iron | balance. |

An infiltration metal selected is an AISI 4140 steel having the following composition by weight:

| | |
|---|---|
| carbon | 0.36% to 0.44% |
| manganese | 0.70% to 1.00% |
| silicon | 0.15% to 0.30% |
| chromium | 0.80% to 1.15% |
| molybdenum | 0.15% to 0.25% |
| phosphorous | 0.035% max. |
| sulphur | 0.04% max. |
| iron | balance. |

The material for the preform is aluminum oxide in a particulate form. The alumina particles have a mesh size in the range of about 20 to 30.

Figure 2:
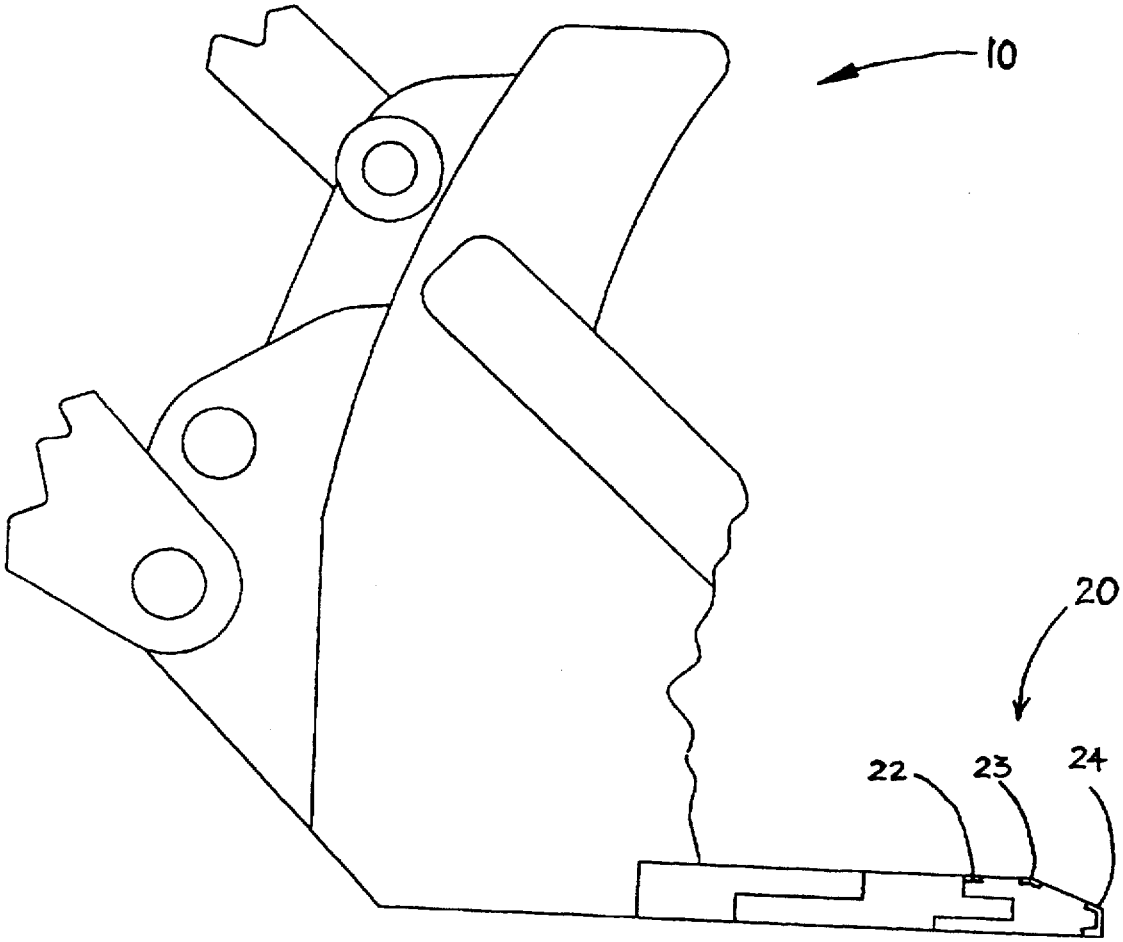
FIG. 2 is a diagrammatic side view of a ground engaging tool, such as a bucket of a dozer, having a GET component selectively reinforced with a metal matrix composite component, according to one embodiment of the present invention.
Figure 3:
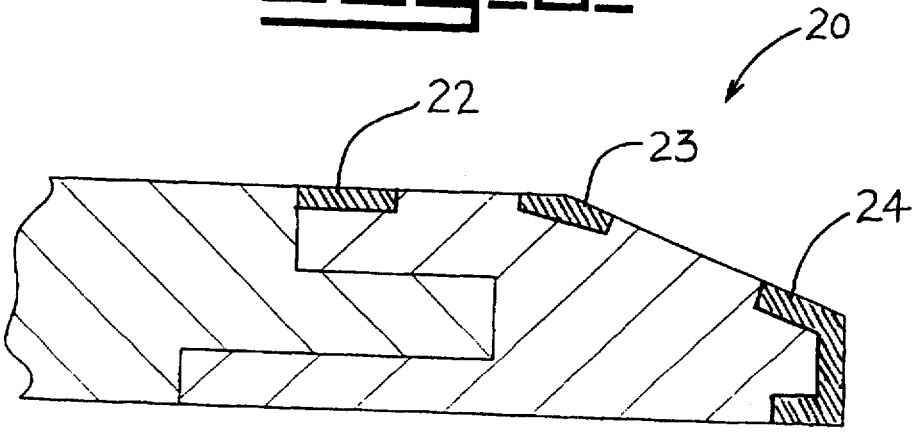
FIG. 3 is a enlarged diagrammatic sectional side view of a portion of FIG. 2, showing the GET component, according to one embodiment of the present invention.

Referring to FIG. 1, which shows a schematic illustration of the process, three critical wear surfaces are identified on a GET component, such as a bucket edge by discrete element analysis which involves the prediction of the force and pressure distribution on the GET component. Referring to FIGS. 2 and 3, a bucket 10 has a bucket edge 20. Bucket edge 20 has a first critical wear surface 22, a second critical wear surface 23, and a third critical wear surface 24.

On surface 22,23,24 metal matrix composite components are deposited by pressure infiltration casting. The amount of reinforcement preform, i.e., the alumina particles present in the matrix is in the range of 30% to 35% by volume for surface 22, 35% to 45% by volume for surface 23, and 45% to 55% by volume for surface 24.

The pressure infiltration casting is carried out as follows: The steel alloy AISI 1527 for making the GET component is placed within a first mold, which has heating elements on the side walls and cooling elements at the bottom. The first mold is preheated to a temperature of about 2642° F. The first mold temperature is maintained during this preheating stage in the range of about 2630° F. to about 2650° F. A second mold, also having heating elements, is placed on the top of the first mold and the two molds are held together by clamping means. Alumina particles are poured into the cavity created by the combination of the first and second molds.

For each metal matrix composite reinforcement, a filter pad made from materials such as alumina is placed on the top of the alumina particles. The filter pad has a porosity in the range of about 25% to 85%. The infiltration metal is then placed on the top of the filter. The second mold is preheated to a temperature of about 2825° F. The second mold temperature is maintained during this heating stage in the range of about 2775° F. to about 2875° F. The infiltration metal, i.e., AISI 4140 steel is melted and becomes the infiltration charge. A vacuum of about 600 mm Hg is maintained in the alumina preforms via a tube inserted into the filter pad and connected at the other end to a vacuum pump. The entire apparatus is placed in a pressure vessel and pressurized to a pressure of about 1500 psig. The molten steel alloy infiltrates the alumina preform and causes local melt formation of the alloy steel of the GET component metal. A fusion bonding of the infiltrant metal and the tool metal occurs with accompanying physical and mechanical interlocking of the alumina preform in the melt at the interface.

Industrial Applicability

The present invention is particularly useful to the construction, mining and earthworking equipment industry for making ground engaging elements for abrasion and impact duty applications. In typical abrasion duty applications, both penetration and wear resistance are required, such as for dozing clay, loam, silt, sand, and gravel. In typical impact duty applications, more fracture strength is required, such as for dozing blasted rock, slabs and boulders in a mining environment.

This invention is particularly useful for making impact and wear resistant GET components that also have the ability to retain their original shape and dimensional relationship even after repeated use. Some examples of such GET components are a profiler shank and cutting edges for various earthworking machines such as motor graders, dozers, excavator buckets, wheel loader buckets, front shovel buckets and scrapers. Other applications include dozer end bits and compacter feet, including chopper blades and plus tips for landfill applications. Yet other applications include bucket tips for wheel loaders, dozers, excavators, front shovels and backhoe loader buckets.

Other aspects, objects and advantages of this invention can be obtained from a study of the drawings, the disclosure and the appended claims.

I claim:

1. A process for selectively reinforcing a ground engaging tool component for an earth working machine with a wear and impact resistant metal matrix composite component, comprising the steps of:

selecting a metal ground engaging tool component;

identifying one or more critical wear surfaces on said ground engaging tool component, said critical wear surfaces being subjected to at least 25% greater wear forces as compared to remaining surface on said ground engaging tool component; and selectively reinforcing said ground engaging tool component by depositing one or more metal matrix composite components at said one or more identified critical wear surfaces on the ground engaging tool component;

said one or more metal matrix composite components consisting of;

a reinforcement preform, said preform being formed from a material selected from one of ceramic, cermet or mixtures thereof;

a metal selected from one of iron, alloy steel, or mixtures thereof;

said reinforcement preform being present in said metal matrix composite in the range of about 30% to about 60% by volume.

2. A process, as set forth in claim 1, wherein said step of identifying includes predicting wear patterns of said surface of said ground engaging tool component by finite element analysis of wear mechanisms when said ground engaging tool component is being used to penetrate soil and rocks.

3. A process, as set forth in claim 2, wherein said step of predicting includes determining load and pressure distribution on said surface of said ground engaging tool component.

4. A process, as set forth in claim 2, wherein said step of predicting includes determining incremental changes in dimensional relationships of said one or more critical wear surfaces on said ground engaging tool component.

5. A process, as set forth in claim 4, wherein said step of predicting includes determining one or more critical wear areas being subjected to at least about 25% incremental change in dimensional relationships by being exposed to said wear forces.

6. A process, as set forth in claim 1, wherein said metal ground engaging tool component is formed from an alloy steel having a composition by weight percent, comprising, 0.22 to 0.29 carbon, 1.20 to 1.50 manganese, no greater than 0.04 phosphorous, no greater than 0.05 sulfur, and balance iron.

7. A process, as set forth in claim 1, wherein said metal ground engaging tool component is formed from an alloy steel having a composition by weight percent, comprising, 0.36 to 0.44 carbon, 0.70 to 1.00 manganese, 0.15 to 0.30 silicon, and 0.80 to 1.15 chromium, 0.15 to 0.25 molybdenum, no greater than 0.035 phosphorous, no greater than 0.04 sulfur, and balance iron.

8. A process, as set forth in claim 1 wherein, said step of selectively reinforcing includes depositing said metal matrix composite components having a greater amount by volume % of said reinforcement preform at those critical wear surfaces being subjected to greater wear forces, as compared to those critical surfaces being subjected to lesser wear forces.

9. A process, as set forth in claim 8, wherein said step of selectively reinforcing includes depositing said metal matrix composite components having said reinforcement preform being continuously graded in the range of about 30% to about 60% by volume of said metal matrix composite.

10. A process, as set forth in claim 9, wherein said step of depositing said metal matrix composite components having said reinforcement preform being continuously graded in the range of about 30% to about 60% by volume of said metal matrix composite includes continuously grading with an amount of gradient sufficient to impart wear resistance that offsets any wear forces gradient on said identified critical wear component.

11. A process, as set forth in claim 1 wherein, said reinforcement preform has the configuration of one of a porous pack, particulates, tubules, platelets, pellets, spheres, fibers, woven mat, whiskers and mixtures thereof.

12. A process, as set forth in claim 1, wherein said metal matrix composite component is deposited by cast pressure infiltration process.

13. A process as set forth in claim 12, wherein said metal matrix composite component consists of a reinforcement preform having interconnecting porosity and being formed from one of ceramics, cermets, and mixtures thereof, an infiltration metal selected from one of iron, alloy steel, or mixtures thereof, said infiltration metal having a melting temperature equal to or greater than the melting temperature of said metal around engaging tool component, said porosity of said preform being infiltrated by said infiltration metal, and said infiltration metal being fusion bonded to said metal ground engaging tool component.

14. A process, as set forth in claim 13, wherein, said preform, prior to being infiltrated by said infiltration metal, has a total porosity in the range of about 40% to about 60% out of which, the interconnecting porosity is at least 90% of the total porosity.

15. A process, as set forth in claim 14, wherein said interconnecting porosity is at least 98% of the total porosity.

16. A process, as set forth in claim 13, wherein said ceramic material is aluminum oxide.

17. A process, as set forth in claim 13, wherein said infiltration metal is formed from alloy steel having a composition by weight %, comprising, 0.36 to 0.44 carbon, 0.70 to 1.00 manganese, 0.15 to 0.30 silicon, 0.80 to 1.15 chromium, 0.15 to 0.25 molybdenum, no greater than 0.035 phosphorous, no greater than 0.04 sulphur, and balance iron.

18. A process, as set forth in claim 13, wherein said infiltration metal is formed from alloy steel having a composition by weight %, comprising, 0.25 to 0.32 carbon, 0.50 to 0.90 manganese, 1.40 to 1.80 silicon, 1.60 to 2.00 chromium, no greater than 0.50 nickel, 0.30 to 0.40 molybdenum, no greater than 0.035 phosphorous, no greater than 0.04 sulphur, no greater than 0.15 copper, no greater than 0.03 aluminum, no greater than 0.02 vanadium, 0.025 to 0.04 zirconium, and balance iron.

19. A process, as set forth in claim 13, wherein said preform, after being infiltrated by said infiltration metal, has a final porosity no greater than 2%.

20. A process for selectively reinforcing a ground engaging tool component for an earthworking machine with a wear and impact resistance metal matrix composite component comprising the steps of:

selecting a steel ground engaging tool component;

identifying one or more critical wear surfaces on said ground engaging tool component, said critical wear surfaces being subjected to at least 25% greater wear forces as compared to remaining surface on said ground engaging tool component; and selectively reinforcing said ground engaging tool component by depositing one or more metal matrix composite components at said one or more identified critical wear surfaces on said ground engaging tool component;

said one or more metal matrix composite components consisting of;

a reinforcement preform having in the range of about 40% to about 60% interconnecting porosity and being formed from a ceramic material selected from one of titanium carbide aluminum oxide, titanium diboride, tungsten carbide;

in infiltration metal selected from one of iron, alloy steel, or mixtures thereof, said infiltration metal having a melting temperature equal to or greater than the melting temperature of said steel ground engaging tool component;

said porosity of said preform being infiltrated by said infiltration metal being fusion bonded to said steel ground engaging tool component.

21. A process for selectively reinforcing a ground engaging tool component for an earthworking machine with a wear and impact resistant metal matrix composite component, comprising the steps of:

selecting a metal ground engaging tool component;

identifying one or more critical wear surfaces on said ground engaging tool component;

said critical wear surfaces being subjected to at least 25% greater wear forces as compared to remaining surface on said ground engaging tool component; and selectively reinforcing said ground engaging tool component by depositing one or more metal matrix composite components at said one or more identified critical wear surfaces on said ground engaging tool component by pressure and infiltration casting process wherein said metal matrix composite component is fusion bonded to said metal ground engaging tool component.

* * * * *

UNITED STATES PATENT AND TRADEMARK OFFICE

CERTIFICATE OF CORRECTION

PATENT NO. : 5,896,911

DATED : April 27, 1999

INVENTOR(S) : Gerald A. Gegel

It is certified that error appears in the above-identified patent and that said Letters Patent is hereby corrected as shown below:

Column 9, line 40, delete "around" and insert --ground--

Signed and Sealed this

Fourteenth Day of December, 1999

*Attest:*

*Attesting Officer*

Q. TODD DICKINSON

*Acting Commissioner of Patents and Trademarks*